US010370908B2

(12) United States Patent
Lee et al.

(10) Patent No.: US 10,370,908 B2
(45) Date of Patent: Aug. 6, 2019

(54) DRILL STRING ELEMENT AND DETACHABLE DRIVING ELEMENT

(71) Applicant: Paul Bernard Lee, Kelowna (CA)

(72) Inventors: Paul Bernard Lee, Kelowna (CA); Dayln Beazer, Calgary (CA)

(73) Assignee: Paul Bernard Lee, Kelowna (CA)

( * ) Notice: Subject to any disclaimer, the term of this patent is extended or adjusted under 35 U.S.C. 154(b) by 59 days.

(21) Appl. No.: 15/525,902

(22) PCT Filed: Oct. 27, 2015

(86) PCT No.: PCT/GB2015/053214
§ 371 (c)(1),
(2) Date: May 10, 2017

(87) PCT Pub. No.: WO2016/075432
PCT Pub. Date: May 19, 2016

(65) Prior Publication Data

US 2017/0314339 A1 Nov. 2, 2017

(30) Foreign Application Priority Data

Nov. 10, 2014 (GB) ..... 1419985.5

(51) Int. Cl.

| | |
|---|---|
| ***E21B 17/06*** | (2006.01) |
| ***E21B 17/046*** | (2006.01) |
| ***E21B 23/00*** | (2006.01) |
| *E21B 33/06* | (2006.01) |

(52) U.S. Cl.
CPC ..... *E21B 17/06* (2013.01); *E21B 17/046* (2013.01); *E21B 23/006* (2013.01); *E21B 33/061* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,098,667 | A * | 7/1963 | Greenwood | E21B 17/06 166/237 |
| 3,211,479 | A | 10/1965 | Brown | |
| 3,974,875 | A | 8/1976 | Herd et al. | |
| 5,086,843 | A | 2/1992 | Mims et al. | |
| 2006/0076741 | A1 | 4/2006 | Lim | |
| 2014/0251631 | A1* | 9/2014 | Curtiss | E21B 43/0122 166/338 |

FOREIGN PATENT DOCUMENTS

| | | |
|---|---|---|
| GB | 1490628 | 11/1977 |
| WO | 2013/151527 | 10/2013 |

* cited by examiner

*Primary Examiner* — Giovanna C Wright
*Assistant Examiner* — Ronald R Runyan
(74) *Attorney, Agent, or Firm* — Kirton McConkie; Evan R. Witt

(57) ABSTRACT

An assembly of a drill string element adapted to be held by the drill pipe rams of a blowout preventer (BOP) to enable the drill string to be disconnected at the BOP and a detachable driving element is described. The drill string element comprises a housing portion defining a longitudinal bore along a longitudinal axis X-X of the housing portion. At least one recess is arranged in the longitudinal bore, said at least one said recess (8) being arranged to engage at least one lug of a detachable driving element arranged to be disposed in the longitudinal bore to rotationally lock the housing portion and detachable driving element together.

7 Claims, 7 Drawing Sheets

DRILL STRING ELEMENT AND DETACHABLE DRIVING ELEMENT

The present invention relates to a drill string element adapted to be held by the drill pipe rams of a blowout preventer (BOP) to enable the drill string to be disconnected at the blowout preventer and also relates to a detachable driving element adapted to detachably engage the drill string element and relates particularly, but not exclusively, to a drill string assembly comprising a drill string element and detachable driving element.

Modern offshore hydrocarbon drilling operations generally comprise an oil rig on the surface of the sea and a riser pipe connecting the oil rig to a wellbore being drilled on the sea bed by drill string passing down from the rig through the riser pipe. An apparatus known as a blowout preventer (BOP) is connected between the riser pipe and the entrance to the wellbore on the sea bed. The BOP is a safety apparatus designed to prevent hydrocarbons leaking in a uncontrolled manner from the wellbore should there be a failure of the drilling operation.

For example, in the formation being drilled under the sea bed hydrocarbons can be stored under pressure in rock being drilled and might be released suddenly causing an increase in pressure in the wellbore. Such an event is known as a kick and the blowout preventer on the sea bed has several sealing mechanisms arranged to be engaged to prevent a dangerous release of hydrocarbon up through the riser pipe and onto the rig at the surface following a kick. If hydrocarbons are released onto the rig in an uncontrolled manner, they can readily find a source of ignition and cause an explosion.

Such an event occurred in 2010 in the Gulf of Mexico on the Deepwater Horizon offshore oil rig. Following a failure of the BOP, an explosion was caused on the drilling rig. Subsequent failures led to a catastrophic failure of the blowout preventer which resulted in an uncontrolled release of hydrocarbons at the sea bed leading to the largest offshore oil spill in US history.

Following this incident, strict new legislation has been implemented which requires a mechanical function test of the shear rams of a BOP every seven days. The shear rams of a BOP are intended to be the final failsafe of several different sealing mechanisms and are designed to shear through the drill string to completely seal off the wellbore. As a result of this, the drill string running from the oil rig and down into the wellbore is required to be removed from the wellbore to test the shear rams of the BOP every seven days. This is a particularly costly process and means that drilling operations must be frequently interrupted by completely removing the drill string from the wellbore.

WO2013/151527 describes a method and apparatus for pressure-actuated tool work string connection and disconnection using a BOP. The sealing rams of the BOP are closed around the tool defining first and second pressure zones adjacent the tool. A differential pressure is then applied across the pressure zones which moves a piston element in the tool axially up and down. A track and ball follower is provided that converts the axial movement of the piston into rotation by the ball follower moving along the inclined track. This translates the axial movement of the piston into rotational movement of the outer sleeve of an upper tool element. The rotational movement of the upper sleeve unscrews a thread formed at the bottom of the upper sleeve from a corresponding thread in a lower tool element. Once the thread is completely unscrewed, the upper and lower tool elements can be separated.

This apparatus suffers from the drawback that the sealing rams of the BOP must be used to create different pressure zones over which a pressure differential must be controlled to cycle a piston. This is a complicated and time consuming process and the hydraulic and mechanical elements required to accomplish the conversion of the cycling of an axial piston into rotational movement of an outer sleeve can be costly. Also, since a large number of hydraulic and mechanical parts are required, there is also an increased risk of tool failure.

A preferred embodiment of the present invention seeks to overcome the above disadvantages of the prior art.

According to an aspect of the present invention, there is provided a drill string element adapted to be held by the drill pipe rams of a blowout preventer to enable the drill string to be disconnected at the blowout preventer, the drill string element comprising:

a housing portion adapted to be engaged and held by the drill pipe rams of a blowout preventer, the housing portion defining a longitudinal bore along a longitudinal axis of the housing portion;

at least one recess arranged in the longitudinal bore, said at least one recess arranged to engage at least one lug of a detachable driving element arranged to be disposed in the longitudinal bore to rotationally lock the housing portion and detachable driving element together;

at least one first guide surface arranged in the longitudinal bore, said at least one first guide surface arranged to slidably engage with said at least one lug when said detachable driving element is advanced along said longitudinal axis in a first direction to cause said detachable driving element to rotate through a first angle relative to the housing portion about said longitudinal axis;

at least one second guide surface arranged in the longitudinal bore, said at least one second guide surface arranged to slidably engage with said at least one lug when said detachable driving element is retracted along said longitudinal axis in a second direction, opposite to said first direction, to cause said detachable driving element to rotate through a second angle relative to the housing portion about said longitudinal axis to a position in which further retraction of said detachable driving element causes said at least one lug to bypass said at least one recess to enable the detachable driving element to be removed from said longitudinal bore and detached from said housing portion.

This provides the advantage of a drill string element that can be held by the drill pipe rams of a blowout preventer (BOP) and disconnected from the part of the drill string extending from the rig on the surface to the blowout preventer. The drill pipe rams of a BOP are a safety feature usually disposed at a lower part of the BOP than the shear rams. The drill pipe rams are arranged to seal around the drill string in the BOP to seal off the annular space surrounding the drill string to which hydrocarbons travel to the surface via the riser. However, since the drill pipe rams do not shear the drill string, they can be used to hold a sub element of the string to enable the lower part of the drill string to hang off the drill pipe rams down the wellbore such that the upper part of the drill string ending at the detachable driving element can be retracted upwardly to enable the shear rams of the BOP to be tested periodically.

This is advantageous because it means that the entire drill string does not have to be removed from the wellbore to test the blowout preventer. This saves a significant amount of time and therefore cost by reducing interruptions in drilling operations.

This also provides the advantage that operators on the surface do not have to control a pressure differential at the BOP to disconnect the tool. All that the operators are required to do is to clamp the tool housing in the BOP and then set down weight from the surface which moves the detachable driving element axially downwardly in the housing portion. Simply lowering the drill or work string from the surface is much simpler and less costly than having to cycle a piston to translate axial movement of the piston into rotational movement of an outer sleeve as is known in the art.

This also provides the advantage of a very simple mechanical interface which is easy to reconnect without any further components being required.

In a preferred embodiment, when the housing portion is engaged and held by the drill pipe rams of a blowout preventer, the detachable driving element is axially moveable relative to the housing portion by lowering or raising the drill string in which the detachable driving element and drill string elements are mounted.

In a preferred embodiment, the drill string element further comprises at least one third guide surface formed in the housing portion and being arranged to slidably engage with said at least one lug when said detachable driving element is inserted into said housing portion along said longitudinal axis in said first direction to cause said detachable driving element to rotate to a position in which further advancement of said detachable driving element in said first direction causes said at least one lug to bypass said at least one recess to enable the detachable driving element to be slidably engaged with said at least one first guide surface.

This provides the advantage of simplifying re-alignment of the detachable driving element with the longitudinal bore of the housing portion to put said at least one lug in the correct orientation to be re-engaged with the said at least one said guide surface of the housing portion. This simplifies reconnection of the drill string for operators on the surface and therefore speeds up the re-commencement of the drilling operation.

The drill string element may further comprise a lower spline guide mountable in said longitunal bore, wherein said at least one first guide surface is formed on said lower spline guide.

This provides the advantage of simplifying manufacture of the drill string element.

The drill string element may further comprising an upper spline guide mountable in said longitunal bore, wherein said at least one second and third guide surfaces are formed on said upper spline guide.

This provides the advantage of simplifying manufacture of the drill string element.

In a preferred embodiment, the drill string element further comprises a plurality of recesses, first, second and third guide surfaces disposed rotationally symmetrically in said longitudinal bore to respectively engage with a corresponding plurality of rotationally symmetrically disposed lugs of a detachable driving element.

This provides the advantage of simplifying reconnection of the housing portion with the detachable driving element because the simple downward motion of the detachable driving element causes the lugs to engage into the third guide surfaces disposed rotationally symmetrically in said longitudinal bore and force the detachable driving element to rotate until it finds the bypass channel in the housing portion. This rotating motion is automatic and is a function of the downward force on the sloped profile of the third guide surfaces.

According to another aspect of the present invention, there is provided a detachable driving element adapted to detachably engage a drill string element adapted to be held by the drill pipe rams of a blowout preventer to enable the drill string to be disconnected at the blowout preventer, the detachable driving element comprising: a shaft portion; and at least one lug disposed on said shaft portion, said at least one lug arranged to be disposed in at least one recess of a longitudinal bore of a housing portion of said drill string element to rotationally lock the housing portion and detachable driving element together.

This provides the advantage of an apparatus that can be used to disconnect a drill string at the drill pipe rams of a blowout preventer (BOP) to enable the lower part of the drill string to hang off the drill pipe rams down a wellbore such that the upper part of the drill string ending at the detachable driving element can be retracted upwardly to enable the shear rams of the BOP to be tested periodically.

This is advantageous because it means that the entire drill string does not have to be removed from the wellbore to test the blowout preventer. This saves a significant amount of time and therefore cost by reducing interruptions in drilling operations.

In a preferred embodiment, the detachable driving element further comprises plurality of rotationally symmetrically disposed lugs.

This provides the advantage of simplifying reconnection of the detachable driving element with the lower part of the drill string because operators on the surface will be required to rotate the detachable driving element through a smaller angle until the respective lugs find the correct position for reinsertion into the housing portion.

According to a further aspect of the present invention, there is provided a drill string assembly comprising:

a drill string element according as defined above; and a detachable driving element as defined above.

This provides the advantage of an assembly that can be used to disconnect a drill string at the drill pipe rams of a blowout preventer (BOP) to enable the lower part of the drill string to hang off the drill pipe rams down a wellbore such that the upper part of the drill string ending at the detachable driving element can be retracted upwardly to enable the shear rams of the BOP to be tested periodically.

This is advantageous because it means that the entire drill string does not have to be removed from the wellbore to test the blowout preventer. This saves a significant amount of time and therefore cost by reducing interruptions in drilling operations.

Preferred embodiments of the present invention will now be described, by way of example only and not in any limitative sense, with reference to the accompanying drawings in which.

Figure 4A:
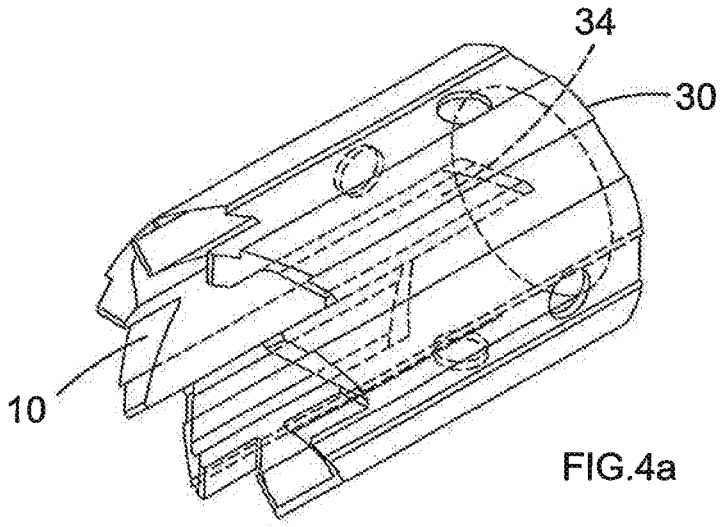
Figure 4B:
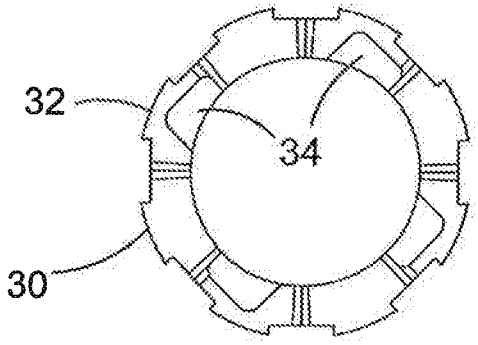

FIG. 4*a* is a perspective view with phantom lines of a lower spline guide;

FIG. 4*b* is a top view of FIG. 4*a;*

Figure 4C:
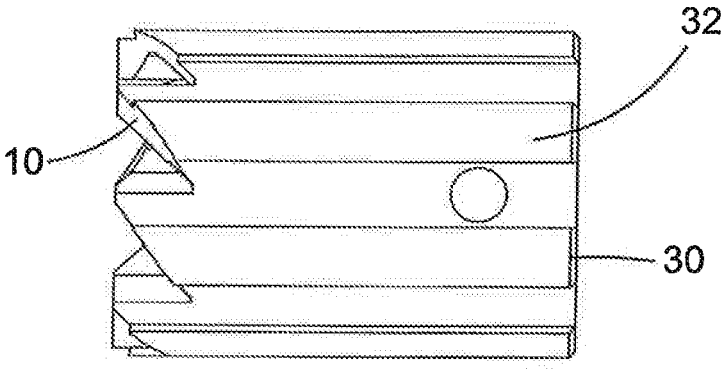

FIG. 4*c* is a side view of the lower spline guide of FIGS. 4*a* and 4*b;*

Figure 5A:
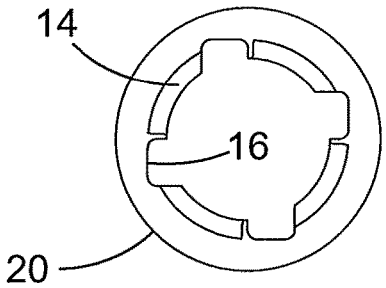
Figure 5B:
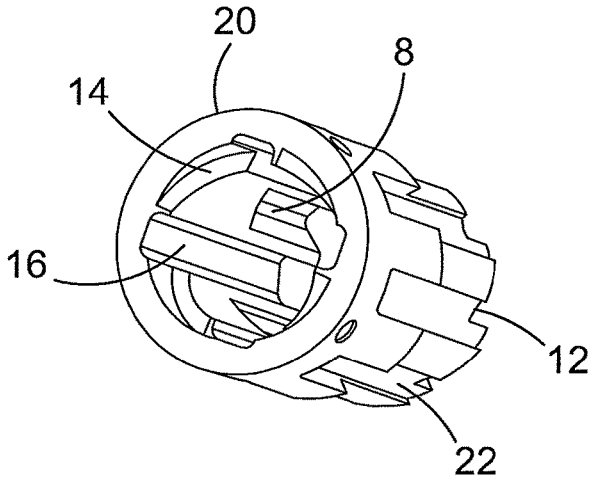

FIG. 5*a* is a front view of an upper spline guide;

FIG. 5*b* is a perspective view from the rear of the upper spline guide of FIG. 5*a;*

Figure 5C:
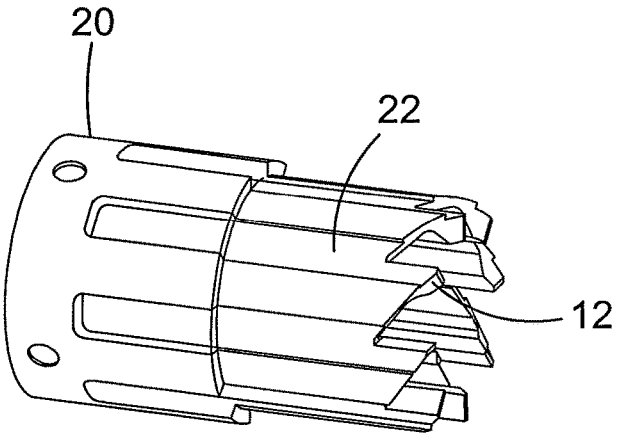

FIG. 5*c* is a perspective view from the side of the upper spline guide of FIGS. 5*a* and 5*b;*

Figure 5D:
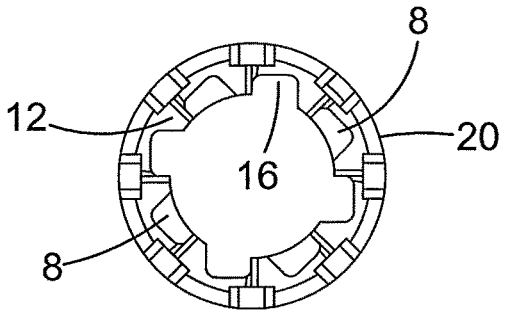

FIG. 5*d* is a rear view of the upper spline guide of FIGS. 5*a* to 5*c;*

Figure 6:
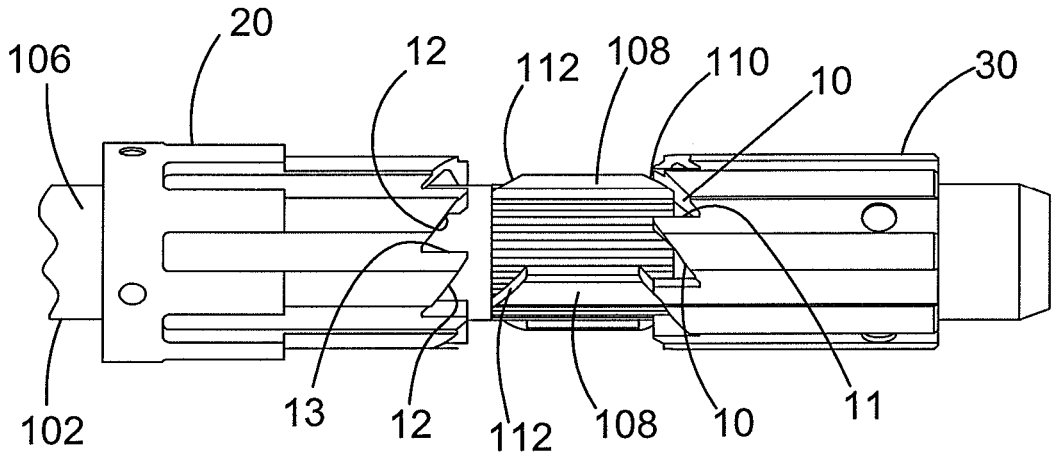
Figure 7:
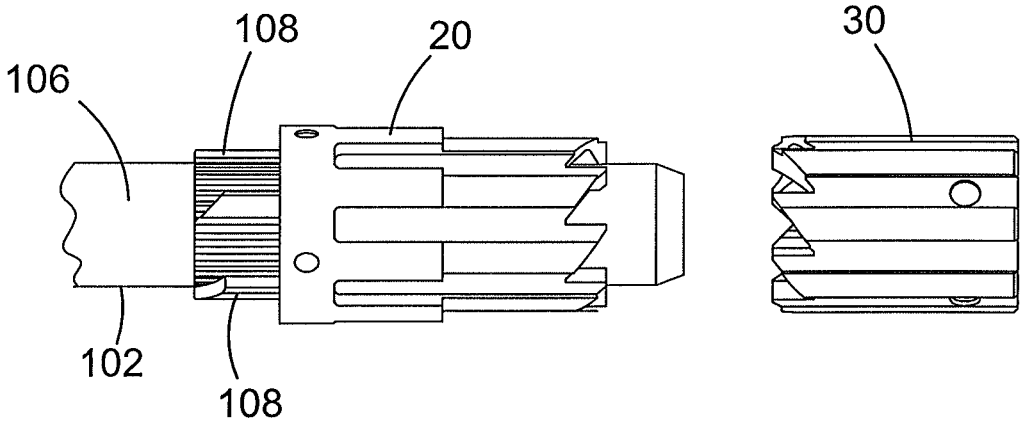
Figure 8:
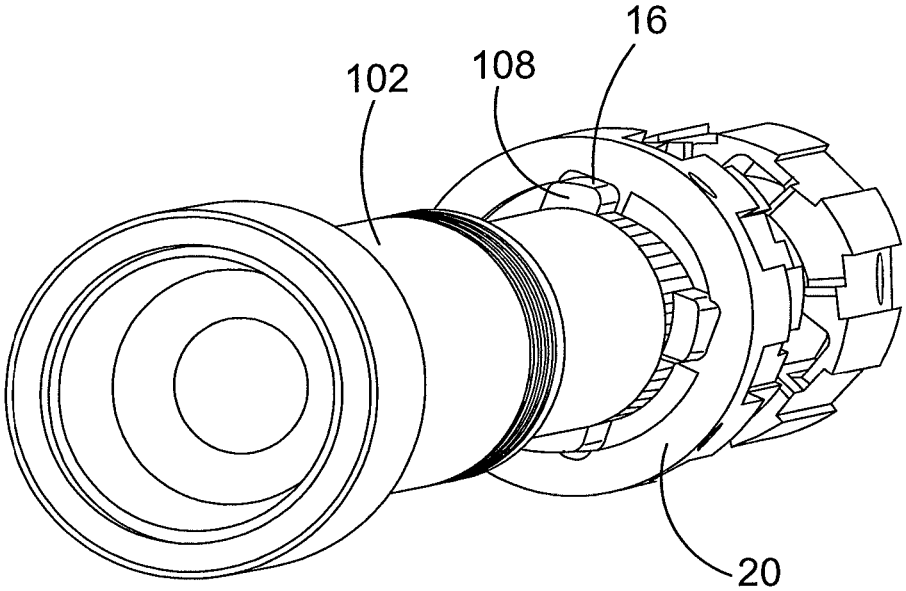
Figure 9:
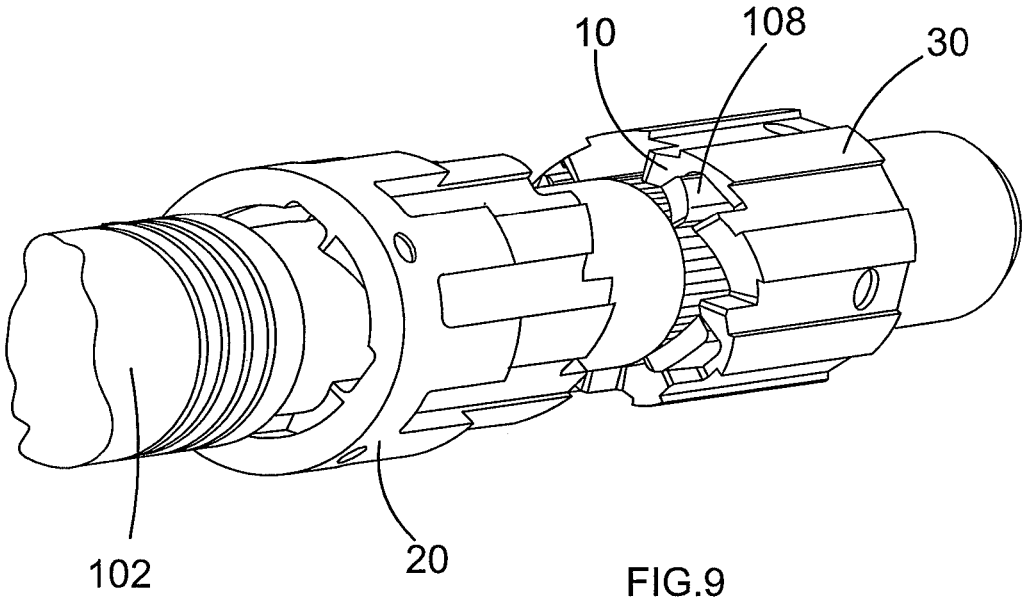
Figure 10:
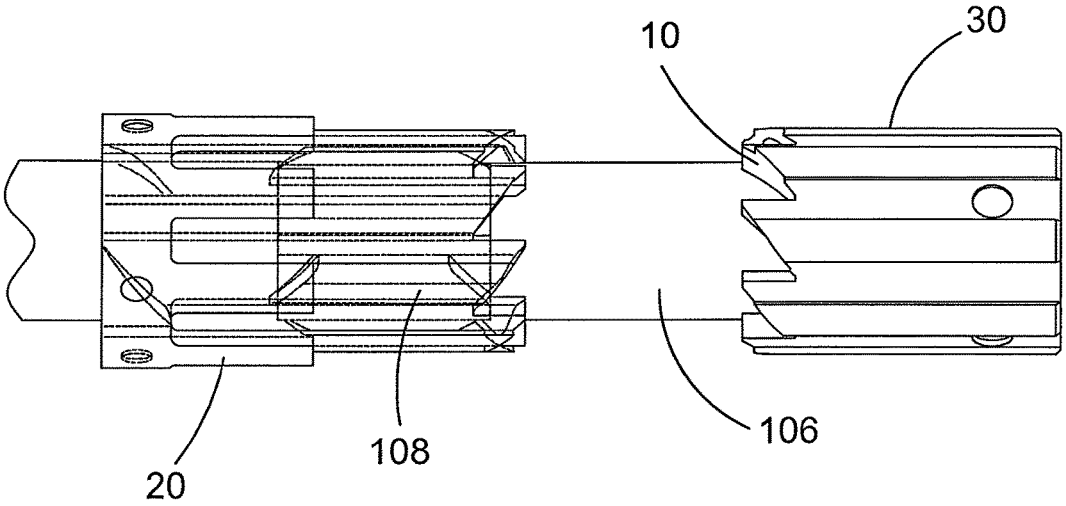

FIG. 6 is a cut-away side view of a first stage of disconnecting the detachable driving element from the drill string element;

FIG. 7 is a second stage of the detachment process;

FIG. 8 is a cut-away perspective view of a first stage of the re-attachment process between the detachable driving element and drill string element;

FIG. 9 is a cut-away perspective view from the rear of a second stage of the re-attachment process; and FIG. 10 is a cut-away side view with phantom lines of a final stage of the re-attachment process between the drill sting element and the detachable driving element.

Referring to FIGS. 1 to 5, a drill string element 2 is adapted to be held by the drill pipe rams of a blowout preventer (BOP) (not shown) to enable the drill string to be disconnected at the BOP. The drill string element 2 comprises a housing portion 4 adapted to be engaged and held by the drill pipe rams of a BOP. The housing portion 4 defines a longitudinal bore 6 along a longitudinal axis X-X of the housing portion 4. At least one recess 8 is arranged in the longitudinal bore 6, said at least one said recess 8 being arranged to engage at least one lug 108 of a detachable driving element 102 arranged to be disposed in the longitudinal bore 6 to rotationally lock the housing portion 4 and detachable driving element 102 together.

At least one first guide surface 10 is arranged in the longitudinal bore 6, the at least one first guide surface 10 being arranged to slidably engage with the at least one lug 102 when said detachable driving element 102 is advanced along said longitudinal axis in a first direction (left to right in FIG. 2) to cause said detachable driving element 102 to rotate through a first angle relative to the housing portion 4 about said longitudinal axis X-X. At least one second guide surface 12 is arranged in the longitudinal bore 6, the at least one second guide surface 12 arranged to slidably engage with the at least one lug 108 when the detachable driving element 102 is retracted along the longitudinal axis X-X in a second direction, opposite to said first direction (right to left in FIGS. 1 and 2) to cause the detachable driving element to rotate through a second angle relative to the housing portion 4 about the longitudinal axis to a position in which further retraction of said detachable driving element 102 causes the at least one lug 108 to bypass the at least one recess 8 to enable the detachable driving element to be removed from the longitudinal bore 6 and detached from the housing portion 4.

The drill string element 2 further comprises at least one third guide surface 14 formed in the housing portion 4 and being arranged to engage with the at least one lug 108 when the detachable driving element 102 is inserted into the 15 housing portion 4 along the longitudinal axis X-X in the first direction to cause the detachable driving element to rotate to a position in which further advancement of the detachable driving element 102 in said first direction causes the at least one lug 108 to bypass the at least one recess 8 to enable to detachable driving element 102 to be slidably engaged with the at least one said guide surface 10.

Figure 2:
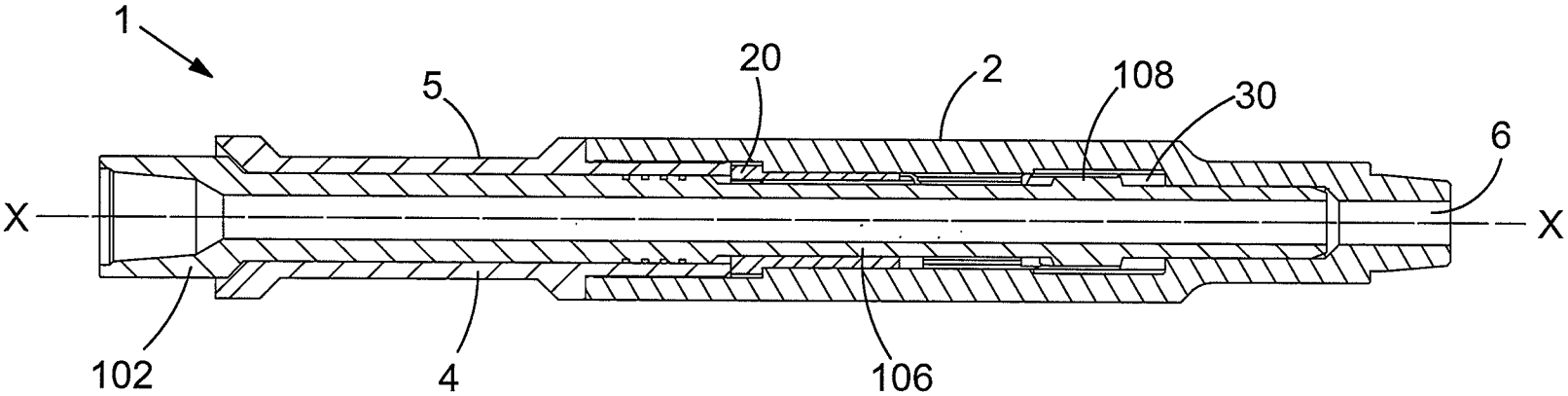
FIG. 2 is a cross-sectional view of the assembly FIG. 1.
Figure 3:
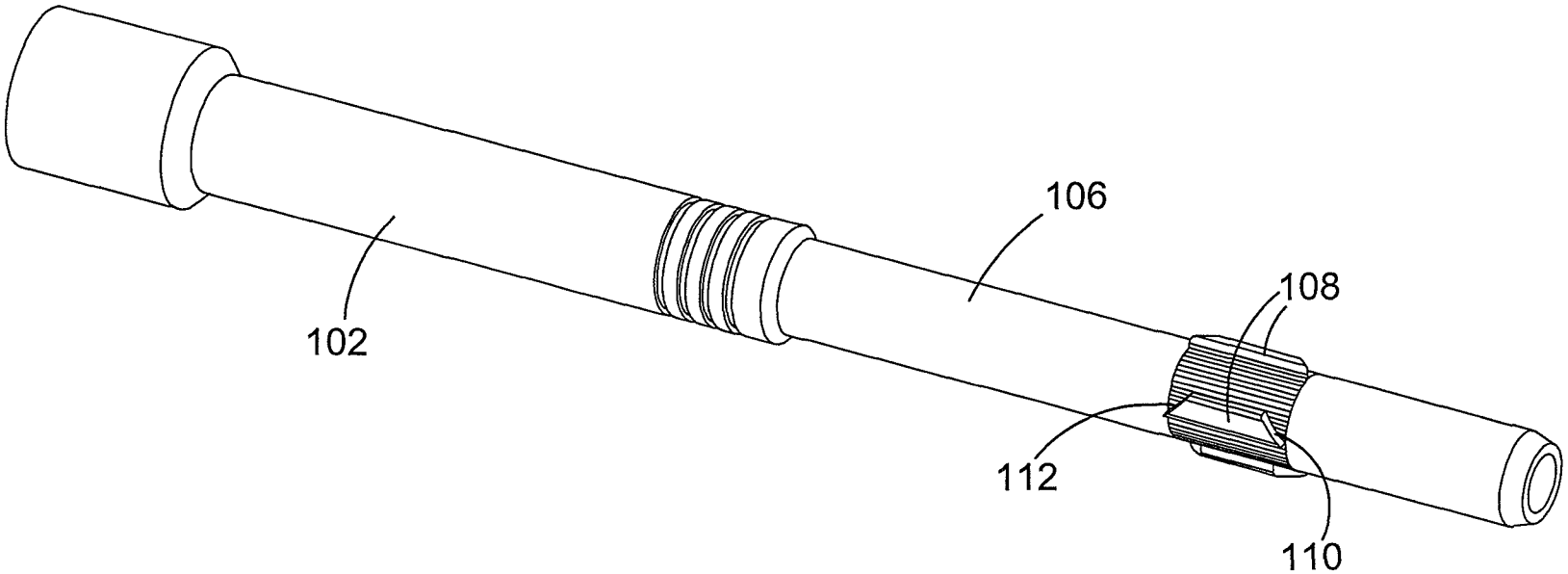
FIG. 3 is a perspective view of the detachable driving element of FIGS. 1 and 2.

Referring to FIGS. 2 and 3, a detachable driving element 102 is adapted to detachably engage a drill string element 2 adapted to be held by the drill pipe rams of a BOP to enable to drill string element to be disconnected at the BOP. The detachable driving element comprises a shaft portion 106 and at least one lug 108 disposed on the shaft portion, the at least one lug arranged to be disposed in at least one recess 8 of a longitudinal bore 6 of a housing portion 4 of the drill string element 2 to rotationally lock the housing portion 4 and detachable driving element 102 together.

Referring to FIGS. 2 and 5, an upper spline guide 20 is mounted in the longitudinal bore 6 of housing portion 4. A plurality of outer splines 22 formed on the upper spline guide 20 engage with a plurality of corresponding ribs (not shown) formed in the housing portion 4 such that the upper spline guide 20 is rotationally fixed and rotates with housing portion 4. Recess 8 in which at least one lug 108 of the detachable driving element 102 sits when the detachable driving element 102 and housing portion 4 are rotationally locked together is formed on the inner surface of upper spline guide 20. Also, at least one second guide surface 12 is formed on the front end of upper spline guide 20. At least one channel 16 is formed in upper spline guide 20 which enables a lug 108 of the detachable driving element 102 to pass through when the detachable driving element 102 is withdrawn and detached from housing portion 104. Although the upper spline guide 20 is a separate part mounted in housing portion 4, the second guide surface 12, recess 8 and channel 16 could be integrally formed in the interior of housing portion 4.

Referring to FIGS. 2 and 4, a lower spline guide 30 is disposed in the longitudinal bore 6 of housing portion 4. A plurality of splines 32 are formed on the outer surface of lower spline guide 30 and engage with a plurality of corresponding ribs (not shown) to rotationally lock the lower spline guide 30 in housing portion 4. A first guide surface 10 is formed on the front end of lower spline guide 30. Although the lower spline guide 30 is shown as a separate component, it should be understood that the at least one first guide surface 10 could be formed integrally in the longitudinal bore 6 of housing portion 4.

It can be seen from the drawings that the detachable driving element 102, lower and upper spline guides 30 and 20 and the housing portion 4 are rotationally symmetrical. In particular, a plurality of lugs 108 correspond with a plurality of recesses and guide surfaces rotationally symmetrically such that there are four rotational orientations in which the detachable driving element 102 can engage with the lower 30 and upper spline guides 20. However, it should be understood by the person skilled in the art that the apparatus can be operated with only a single lug 108 and single corresponding guide surfaces and channels, but to simplify operation for the user, a preferred embodiment is to have a plurality of lugs 108 (such as four as shown in the drawings) and a plurality of corresponding guide surfaces and channels.

It should be understood that although the present invention has been described in relation to a drill string, the present invention is intended for use with any type of downhole work string as would be apparent to persons skilled in the art. References to the term drill string are therefore intended to be non-limiting.

Operation of the assembly 1 of drill string element 2 and detachable driving element 102 to enable a drill string to be disconnected at a BOP during a drilling operation will now be described. The drill string element and detachable driving element 102 are both components that can be incorporated into drill strings in a manner that will be familiar to persons skilled in the art. During a drilling operation, the assembly 1 of detachable driving element 102 and drill string element 2 is incorporated into a drill string and moves down through a riser pipe, through a BOP and into an undersea wellbore as further sub elements are incorporated into the drill string and the drill string is lengthened.

Figure 1:
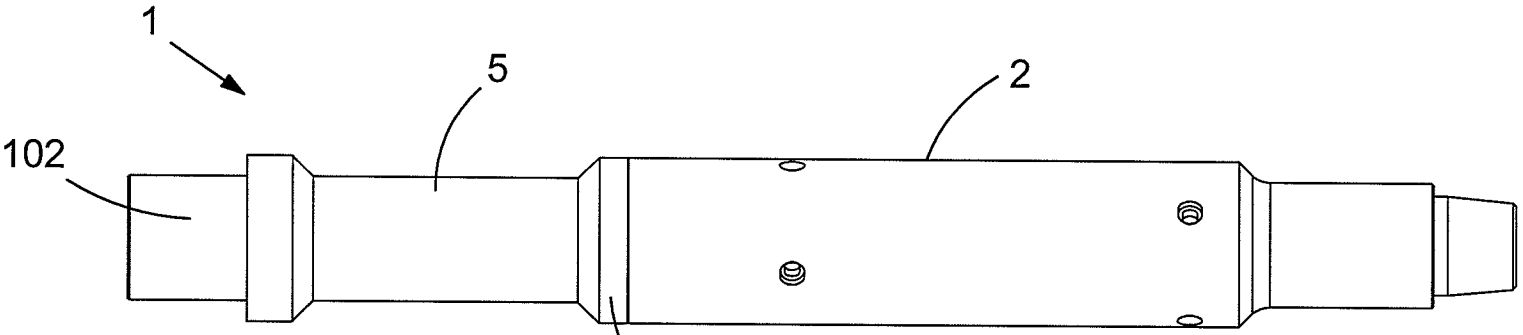
FIG. 1 is a side view of an assembly of a drill string element adapted to be held by the drill pipe rams of a BOP embodying the present invention and a detachable driving element embodying the present invention inserted fully into the housing portion of the drill string element.

During normal drill string operations, the assembly 1 will be in tension. This means that the drill string is effectively hung down a wellbore and drills under its own weight to prevent buckling of the drill string. In this tensioned state, the condition of the assembly is not as shown in FIGS. 1 and 2 but will be in a condition in which lugs 108 sit in the recesses 8 of upper spline guide 20. Since the upper spline guide 20 is rotationally fixed to housing 4, rotation of detachable driving element 102 controlled from the rig on the surface (not shown) is transmitted through recesses 8 and therefore causes the housing portion 4 and the lower part of the drill string to which the housing portion 4 is connected to rotate. This causes the drill bit at the bottom end of the string to drill into formation.

At such time as a test of the shear rams of a BOP is required, the drill string can be raised to a point at which the drill string element 2 is located at the drill pipe rams of the BOP. A recessed portion 5 is formed on drill string element 2. When aligned with recessed portion 5, the drill pipe rams of the BOP can be actuated to close around recessed portion 5. This grips the recessed portion and therefore drill string element 2 in the BOP and effectively holds the drill string in a fixed vertical position. Operators on the surface can then perform a pull test to ensure that the drill pipe rams are engaged and will hold the drill string in which the assembly 1 is incorporated.

Referring to FIG. 6, operators can then set down weight on the drill string. Since the housing portion 2 is vertically held in the drill pipe rams of the BOP, this causes lugs 108 to move downwardly (in the first direction) relative to the housing portion 4. This compressive force applied from the surface causes lugs 108 to move out of recesses 8 and leading inclined surfaces 110 of lugs 108 to slidably engage first guide surfaces 10 of the lower spline guide 30. Further downward advancement in the first direction of detachable driving element 102 causes the detachable driving element 102 to rotate through a first angle relative to the housing portion about the longitudinal axis as a result of sliding engagement between the lugs 108 and first guide surface 10. This causes clockwise rotation of the detachable driving element 102 and therefore causes the detachable driving element 16 to index in a clockwise fashion by a predetermined amount that is limited by stop surface 11.

The next stage in the disconnect procedure is to then retract the detachable driving element 102 upwardly in the second direction such that the rear guide surfaces 112 of lugs 108 engage second guide surfaces 12 of the upper spline guide 20. This causes a second predetermined amount of clockwise rotation of the detachable driving element 102. The detachable driving element therefore indexes through a second angle in a clockwise fashion as a result of sliding engagement between surfaces 12 and 112. The second indexing movement is limited by stop surfaces 13. Once the rotation through the second angle is complete, this aligns lugs 108 with channels 16 (FIG. 5).

Referring to FIG. 7, further upward retraction of the detachable driving element 102 causes lugs 108 to pass through channels 16 such that the detachable driving element 102 can be completely withdrawn from housing portion 4. Further raising of the detachable driving element 102 means that the upper part of the drill string ending with the detachable driving element 102 at the lowermost point can be pulled into the riser pipe and clear of the BOP. The lower part of the drill string starting at drill string element 2 is left hanging down the wellbore by engagement of the drill pipe rams around recessed portion 5 of housing portion 4. The shear pipe rams of the BOP can then be tested without risk of severing the drill string.

Referring to FIGS. 5 and 8, in order to reconnect the detachable driving element 102 with the drill string element 2 to recommence drilling operations, operators on the surface simply lower the drill string down through the riser pipe and into the BOP once the shear rams have been opened. This causes the detachable driving element 102 to pass into the upper end of housing portion 4. The leading edges 110 of lugs 108 come into contact with third guide surfaces 14 disposed on the upper ends of upper spline guide 20. Sliding engagement between lugs 108 and third guide surface 14 causes the detachable driving element to rotate in a clockwise fashion to a position in which lugs 108 are aligned with channels 16 of the lower spline guide 20. This condition is shown in FIG. 8 and enables the detachable driving element 102 to advance downwardly through upper spline guide 20.

Further downward advancement of detachable driving element 102 causes lugs 108 to re-engage with guide surface 10 of lower spline guide 30 and index in a clockwise fashion to a position in which lugs 108 slot into recess guides 34 of the lower spline guide 30. Recess guides 34 are aligned with recesses 8 of the upper spline guide 20. As a consequence, pulling upwardly on detachable driving element 102 then causes the lugs 108 to exit the lower spline guide 30 and slide into recesses 8 of the upper spline guide 20.

The drill pipe rams of the BOP can then be disengaged from recesses 5 of drill string element 2. Drilling can now be recommended by lowering the drill string and rotating to cause the drill bit to cut formation. Subsequent repetition of these steps can then be used to disconnect the drill string again for further BOP testing.

It will be appreciated by persons skilled in the art that the above embodiments have been described by way of example only and not in any limitative sense, and that various alterations and modifications can be made without departure from the scope of the invention as defined by the appended claims. For example, although the drill string element 2 is formed from an assembly of different parts, it would be appreciated by persons skilled in the art that the drill string element could be machined as a single integral part.

The invention claimed is:

1. A drill string element adapted to be held by the drill pipe rams of a blowout preventer to enable the drill string to be disconnected at the blowout preventer, the drill string element comprising:

a housing portion adapted to be engaged and held by the drill pipe rams of a blowout preventer, the housing portion defining a longitudinal bore along a longitudinal axis of the housing portion;

at least one recess arranged in the longitudinal bore, said at least one recess arranged to engage at least one lug of a detachable driving element arranged to be disposed in the longitudinal bore to rotationally lock the housing portion and detachable driving element together;

at least one first guide surface arranged in the longitudinal bore, said at least one first guide surface arranged to slidably engage with said at least one lug when said detachable driving element is advanced along said longitudinal axis in a first direction to cause said detachable driving element to rotate through a first angle relative to the housing portion about said longitudinal axis; and at least one second guide surface arranged in the longitudinal bore, said at least one second guide surface arranged to slidably engage with said at least one lug when said detachable driving element is retracted along said longitudinal axis in a second direction, opposite to said first direction, to cause said detachable driving element to rotate through a second angle relative to the housing portion about said longitudinal axis to a position in which further retraction of said detachable driving element causes said at least one lug to bypass said at least one recess to enable the detachable driving element to be removed from said longitudinal bore and detached from said housing portion.

2. A drill string element according to claim 1, wherein when the housing portion is engaged and held by the drill pipe rams of a blowout preventer, the detachable driving element is axially moveable relative to the housing portion by lowering or raising the drill string in which the detachable driving element and drill string elements are mounted.

3. A drill string element according to claim 1, further comprising at least one third guide surface formed in the housing portion and being arranged to slidably engage with said at least one lug when said detachable driving element is inserted into said housing portion along said longitudinal axis in said first direction to cause said detachable driving element to rotate to a position in which further advancement of said detachable driving element in said first direction causes said at least one lug to bypass said at least one recess to enable the detachable driving element to be slidably engaged with said at least one first guide surface.

4. A drill string element according to claim 1, further comprising a lower spline guide mountable in said longitudinal bore, wherein said at least one first guide surface is formed on said lower spline guide.

5. A drill string element according to claim 1, further comprising an upper spline guide mountable in said longitudinal bore, wherein said at least one second and third guide surfaces are formed on said upper spline guide.

6. A drill string element according to claim 1, further comprising a plurality of recesses, first, second and third guide surfaces disposed rotationally symmetrically in said longitudinal bore to respectively engage with a corresponding plurality of rotationally symmetrically disposed lugs of a detachable driving element.

7. A drill string assembly comprising:

a drill string element adapted to be held by drill pipe rams of a blowout preventer to enable the drill string to be disconnected at the blowout preventer, the drill string element comprising:

a housing portion adapted to be engaged and held by the drill pipe rams of a blowout preventer, the housing portion defining a longitudinal bore along a longitudinal axis of the housing portion;

at least one recess arranged in the longitudinal bore, said at least one recess arranged to engage at least one lug of a detachable driving element arranged to be disposed in the longitudinal bore to rotationally lock the housing portion and detachable driving element together;

at least one first guide surface arranged in the longitudinal bore, said at least one first guide surface arranged to slidably engage with said at least one lug when said detachable driving element is advanced along said longitudinal axis in a first direction to cause said detachable driving element to rotate through a first angle relative to the housing portion about said longitudinal axis; and at least one second guide surface arranged in the longitudinal bore, said at least one second guide surface arranged to slidably engage with said at least one lug when said detachable driving element is retracted along said longitudinal axis in a second direction, opposite to said first direction, to cause said detachable driving element to rotate through a second angle relative to the housing portion about said longitudinal axis to a position in which further retraction of said detachable driving element causes said at least one lug to bypass said at least one recess to enable the detachable driving element to be removed from said longitudinal bore and detached from said housing portion; and a detachable driving element adapted to detachably engage the drill string element, the detachable driving element comprising:

a shaft portion; and at least one lug disposed on said shaft portion, said at least one lug arranged to be disposed in at least one recess of a longitudinal bore of a housing portion of said drill string element to rotationally lock the housing portion and detachable driving element together.

* * * * *